US006511138B1

(12) United States Patent
Gardner et al.

(10) Patent No.: US 6,511,138 B1
(45) Date of Patent: Jan. 28, 2003

(54) DRAWER CLOSING AND LATCHING SYSTEM

(75) Inventors: John F. Gardner, Penfield, NY (US); Shelly I. Slogoff, Chester Springs, PA (US); Jane F. Laycock, West Chester, PA (US); Eric C. Norlin, Coatesville, PA (US); E. Ford Williams, Bryn Mawr, PA (US); Tobin H. Williams, Bryn Mawr, PA (US)

(73) Assignee: Lionville Systems, Inc., Exton, PA (US)

( * ) Notice: Subject to any disclaimer, the term of this patent is extended or adjusted under 35 U.S.C. 154(b) by 96 days.

(21) Appl. No.: 09/717,791

(22) Filed: Nov. 20, 2000

(51) Int. Cl.[7] ..... E05B 65/46
(52) U.S. Cl. ..... 312/217
(58) Field of Search ..... 312/215, 216, 312/217, 218, 219, 220, 221, 222; 292/129, 125, 133, 229, 177, 178, 179, 180, 181, 182

(56) References Cited

U.S. PATENT DOCUMENTS 3,150,902 A * 9/1964 Naab et al. ..... 312/217
4,478,466 A * 10/1984 Clark et al. ..... 312/215
4,993,784 A * 2/1991 Dana et al. ..... 312/221
5,337,977 A * 8/1994 Fleming et al. ..... 244/129.5
5,445,294 A * 8/1995 Gardner et al. ..... 221/1
6,082,839 A * 7/2000 Chiku ..... 312/217
6,170,927 B1 * 1/2001 Dykstra et al. ..... 312/219
6,347,848 B1 * 2/2002 Cho ..... 292/DIG. 18

* cited by examiner

*Primary Examiner*—Janet M. Wilkens
(74) *Attorney, Agent, or Firm*—William H. Eilberg

(57) ABSTRACT

A mechanical system closes and latches one or more drawers in a multiple-drawer cabinet. Drawers which are slightly ajar are grasped by the latching mechanism, pulled fully closed, and locked shut. A latch finger engages a catch connected to the drawer and pulls the drawer closed. The finger is actuated by a crankshaft which, as it rotates, first lowers the latch finger to capture the catch, and then retracts the latch finger and with it the captured drawer. The crankshaft rotates to a position where any pull forces on the finger are nearly in line with the axis of the crankshaft and have little tendency to cause reverse rotation. The crankshaft is then retained in this position, effectively locking the drawer closed. Thus, any drawer which is left slightly ajar, and which may falsely appear to be latched, is subsequently closed and securely locked. The latching mechanism may be motorized or manually operated. If motorized, a controller may actuate the mechanism to close and lock the drawers after some predetermined delay. Unlocking may be enabled by key or by security code entry. The locking capability of this system makes it particularly useful in controlling access to medications in a hospital environment or wherever expensive or potentially dangerous materials are stored.

44 Claims, 9 Drawing Sheets

DRAWER CLOSING AND LATCHING SYSTEM

BACKGROUND OF THE INVENTION

The present invention provides a system for latching, closing, and locking drawers in a cabinet.

Hospitals and other health care facilities often use wheeled cabinets for storing medications and other supplies, and for transporting such medications and supplies from one patient to another. These cabinets generally have numerous drawers, in which many different types of medications may be kept separate within the cabinet. Some of the medications are expensive, and some may be controlled substances, such as narcotics. Thus, the security of the cabinet is important, and various governmental regulations, as well as rules of the particular institution, require that all drawers of such cabinets be locked when the cabinet is unattended.

The prior art contains many examples of cabinets having manual or automatic means for locking drawers. One problem with these prior art cabinets is that it is possible to leave one or more drawers slightly ajar, just beyond the reach of the latching or locking means. If one locks such a cabinet, the drawers which are slightly ajar will remain unintentionally unlocked. Because the unlocked drawers were nearly closed, it would not be visually apparent that one or more drawers had just missed the latch.

Regardless of where a fixed latch is positioned, there is always some drawer position in which the drawer will just miss being latched, and will still look almost the same as another drawer that has been caught by the latch. This ambiguity can result in unattended cabinets in which drawers remain unintentionally unlocked.

The present invention solves the above-described problem, by providing a latch mechanism which pulls each drawer fully closed as part of the latch and lock cycle. The invention is especially useful in medical applications, as described above, but can be used in any other field in which it is necessary to keep one or more drawers locked.

SUMMARY OF THE INVENTION

The present invention comprises a system for latching, closing, locking, and unlocking a drawer, the system being suitable for use in medication transport carts, or with other cabinets of drawers which must be closed and locked after use. The drawers may be arrayed in rows, columns, or both. The present invention includes 1) a drawer latch mechanism with latch fingers which capture the drawers, and which pull the drawers closed if necessary, retaining the drawers such that they cannot be subsequently pulled open until purposely unlatched, and 2) a lock mechanism which provides the motive power for the latching and closing operation, and which provides the means for locking the mechanism so that the drawers remain closed, and which enables mechanical or electromechanical unlocking of the drawers. In the preferred embodiment, the two mechanisms are connected by a cable and pulley system.

The drawer latch mechanism of the present invention includes a plurality of latch fingers, at least one latch finger for each drawer. It also includes a plurality of crankshafts, one for each row of drawers. Each crankshaft has an offset or eccentric crank portion corresponding to each column of drawers. These eccentric crank portions engage the latch fingers to move them in and out and up and down. The crankshafts are synchronously connected by a pair of drive links such that they move in unison. The crankshafts are driven by the interconnecting cable from the lock mechanism, described below. As the crankshafts rotate, the latch fingers first drop down to engage catches on the rear portions of the drawers. Then, as the crankshafts continue to rotate, the latch fingers retract to pull closed any drawers whose catches they have engaged. When the fingers are fully retracted, the drawers are fully closed, and the crankshaft is positioned such that the forces on the latch finger do not significantly tend to rotate the crankshaft. The latter is often called the top-dead-center position.

In addition to latching and pulling the drawers shut, the rotation of the crankshafts also winds a torsion spring. This spring serves to return the latch fingers to their extended and raised (unlatched) position when tension on the interconnecting cable is relaxed.

The lock mechanism provides the motion and force to operate the drawer latch mechanism through the interconnecting cable, and includes means to latch itself in the locked position. This internal latch is released by the operator to unlock the drawers when desired. The motive power for the lock mechanism may be manual or electromechanical. In the manual implementation, the operator moves a handle to close and lock the drawers, and uses a key to unlock and unlatch them. In the electromechanical implementation, a motor is added which may be used to pull the drawers closed until the internal mechanical latch engages. The motor then returns to its home position. To unlock and unlatch the drawers, the operator may either use a key or may cause the motor to perform the unlocking function. If used, the motor momentarily moves in reverse, far enough to disengage the internal latch in the lock mechanism. Once the lock mechanism is unlatched, the interconnecting cable tension is relaxed, allowing a return spring on the drawer latch mechanism to unlatch the drawers and to return the lock mechanism to its unlocked position. Following either manual or electromechanical unlocking, the drawers are opened manually.

The present invention therefore has the primary object of providing a system for closing and locking a drawer.

The invention has the further object of providing a system for closing and locking a plurality of drawers simultaneously, such as the drawers of a cabinet or the like.

The invention has the further object of closing and locking a drawer that has been left some distance ajar.

The invention has the further object of closing and latching all of the drawers of a cabinet which are initially spaced a predetermined distance from a fully closed position.

The invention has the further object of making it visually apparent, to an operator, which drawer of a multiple-drawer cabinet has been left sufficiently ajar to avoid being locked.

The invention has the further object of providing means for locking and unlocking a drawer, both of which may be manually or electromechanically operated.

The invention has the further object of enhancing the security of medications stored in health care facilities.

The reader skilled in the art will recognize other objects and advantages of the present invention, from a reading of the following brief description of the drawings, the detailed description of the invention, and the appended claims.

DETAILED DESCRIPTION OF THE INVENTION

Figure 1:
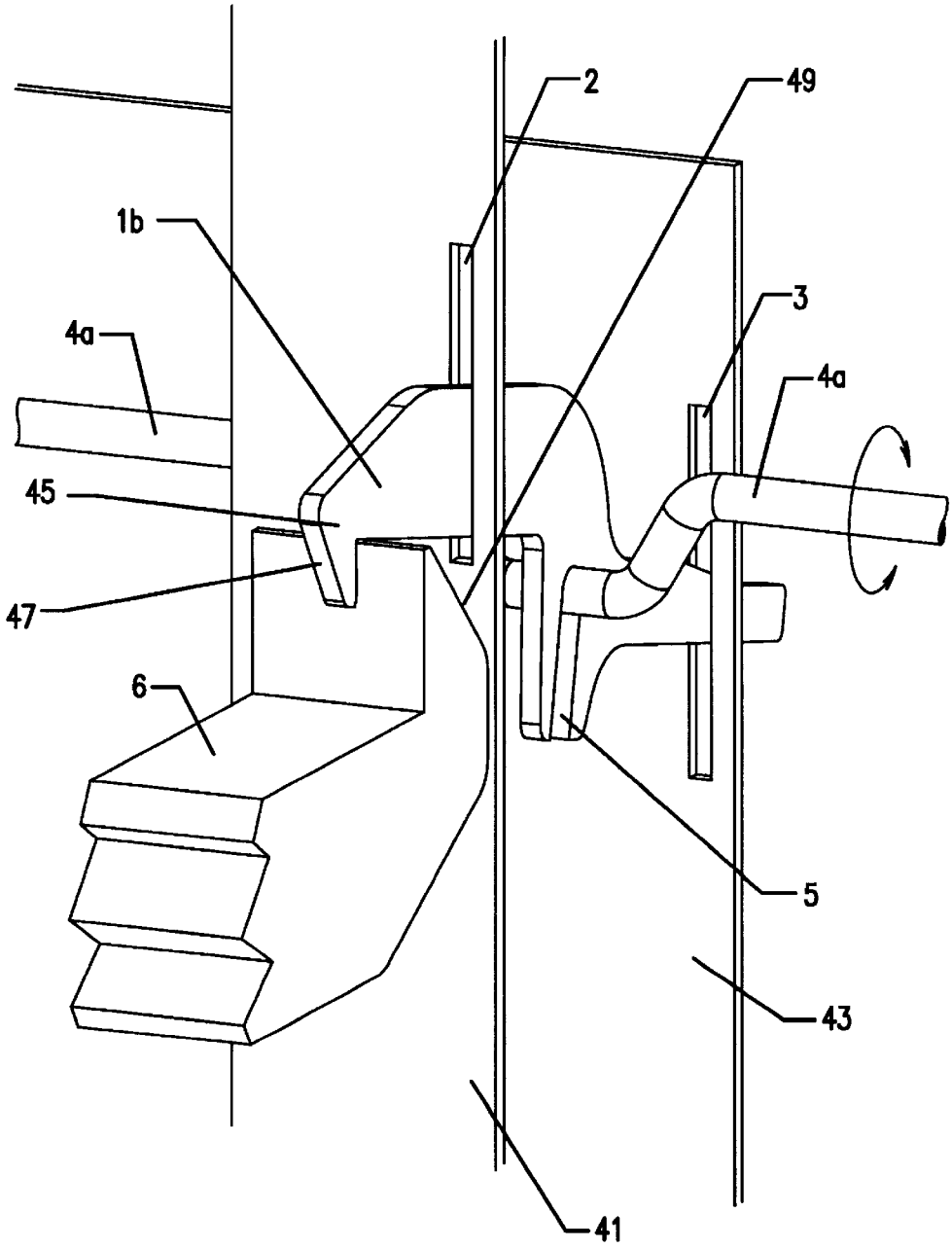
FIG. 1 provides a partial perspective view of the latch mechanism, for a single drawer, made according to the present invention.

FIG. 1 provides a partial perspective view of one arrangement of the latch mechanism of the present invention. FIG. 1 shows a latch mechanism for a single drawer.

The latch mechanism includes latch finger 1*b*, which is constrained to move in openings 2 and 3 formed, respectively, in front plate 41 and rear plate 43. The openings allow the latch finger to move forward and backward freely. The openings have upper and lower ends which define limits for upward and downward movement of the latch finger. In the position shown, the hooked end 45 of the latch finger 1*b* engages catch 6 which is attached to the rear portion of drawer 7 (not shown in FIG. 1, but visible in FIGS. 2A–2D). Crankshaft 4*a* imparts motion to the latch finger by engaging slot 5 formed in the latch finger.

As crankshaft 4*a* rotates clockwise about its axis, from the position shown in FIG. 1, it raises latch finger 1*b* to the top of opening 2 in plate 41. In this raised position, the hooked end 45 of latch finger 1*b* is disengaged from catch 6, thus unlatching the drawer. Conversely, as crankshaft 4*a* rotates counterclockwise about its axis, it remains engaged in slot 5, and causes the latch finger to retract, i.e. to move rearward, pulling catch 6 and the attached drawer with it, and thereby closing and latching the drawer.

FIGS. 2A–2D provide schematic diagrams illustrating the operation of the latch mechanism. These figures show four discrete positions during the latching operation. The eccentric portion of crankshaft 4*a* is represented by the circle in slot 5, and its path of rotation about axis 8 is represented by dotted line 9. It is the eccentric portion of the crankshaft which engages the slot 5. Note also that axis 8 is not a pivot point for the latch finger, but is included only to show the center of the circle along which the eccentric portion travels. As stated earlier, the latch finger can move forward and backward, as well as up or down.

Figure 2A:
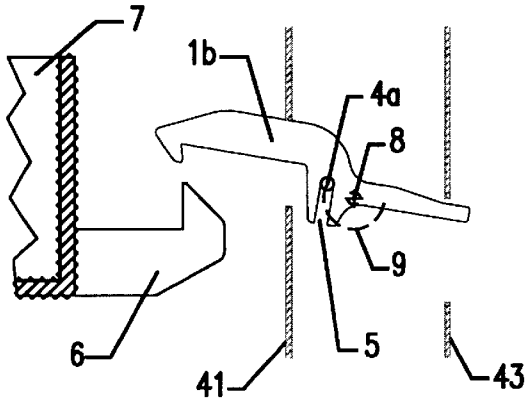
FIGS. 2A–2D provide several schematic views of the latch mechanism, for a single drawer, in various positions during the latching cycle, according to the present invention.

FIG. 2A shows the latch finger 1*b* in the unlatched position, where catch 6 and attached drawer 7 are free to move, unhindered by the latch finger. In FIGS. 2A–2D, the drawer is opened by moving it to the left, and is closed by moving it to the right. Thus, in FIG. 2A, the drawer is free to move to the left, i.e. to the open position.

Figure 2B:
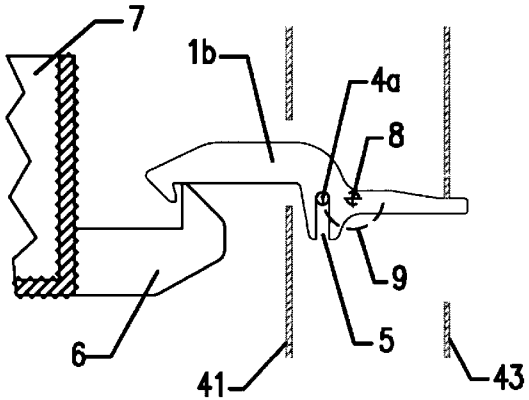

FIG. 2B shows the mechanism after crankshaft 4*a* has rotated counterclockwise sufficiently to allow latch finger 1*b* to engage catch 6. In this position, the eccentric portion of the crankshaft, which is always engaged with slot 5, is aligned with axis 8 such that pulling on drawer 7 will not cause rotation of the crankshaft or disengagement of the latch finger from the catch. At this point, drawer 7 is latched but not fully closed.

Figure 2C:
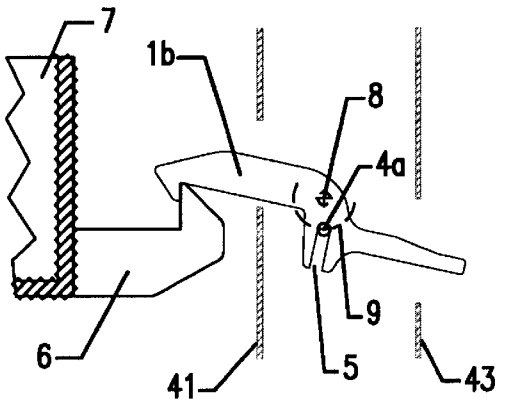

FIG. 2C shows the latch mechanism after further counterclockwise rotation of crankshaft 4*a*. In this figure, the drawer has been partially, but still not fully closed. The crankshaft remains engaged in slot 5 of the latch finger, and the latch finger remains engaged with catch 6 on the back of drawer 7. Note that, in FIG. 2C, the latch finger is tilted as compared with its position in FIG. 2B. This tilted position is due to the fact that, as the eccentric portion of the crankshaft rotates from the position shown in FIG. 2B to that shown in FIG. 2C, it moves down as well as to the rear. The latch finger moves down by gravity, but the hooked end 45 is held up by catch 6, or by the bottom of the opening in front plate 41 when the drawer is not engaged with the catch.

Figure 2D:
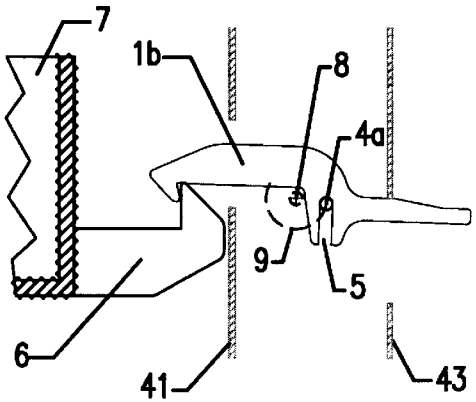

FIG. 2D shows the latch mechanism in the fully closed and locked position. In this figure, catch 6 nearly abuts front plate 41. The eccentric portion of the crankshaft is again sufficiently aligned with axis 8 such that pulling on the latch finger by the catch will not cause rotation of the crankshaft or motion of the latch finger. This is the locked position of the latch mechanism.

If drawer 7 had been sufficiently ajar that the latch finger, when lowered, could not engage the catch, the drawer would have remained unlatched and unmoved after the latch mechanism completed its motion. But other drawers (not shown) in the cabinet would have been successfully latched, and thus would have been moved significantly during the latching operation. Therefore, the drawer that was not latched would be visibly displaced from the drawers that had been latched. This displacement would allow the operator to identify the open drawer, and to close it manually. In this instance, the ramped surfaces 47 and 49 of the latch finger and the catch, respectively, would allow the latch finger to ride over the catch and reach the latched and locked condition shown in FIG. 2D.

Thus, the latch mechanism of the present invention comprises means for pulling all drawers shut which are within a predetermined distance from a fully closed position, and latching such drawers. One can then observe all of the drawers of the cabinet to determine whether any drawers are not fully closed, and can manually close those drawers which were found to be ajar.

Figure 3:
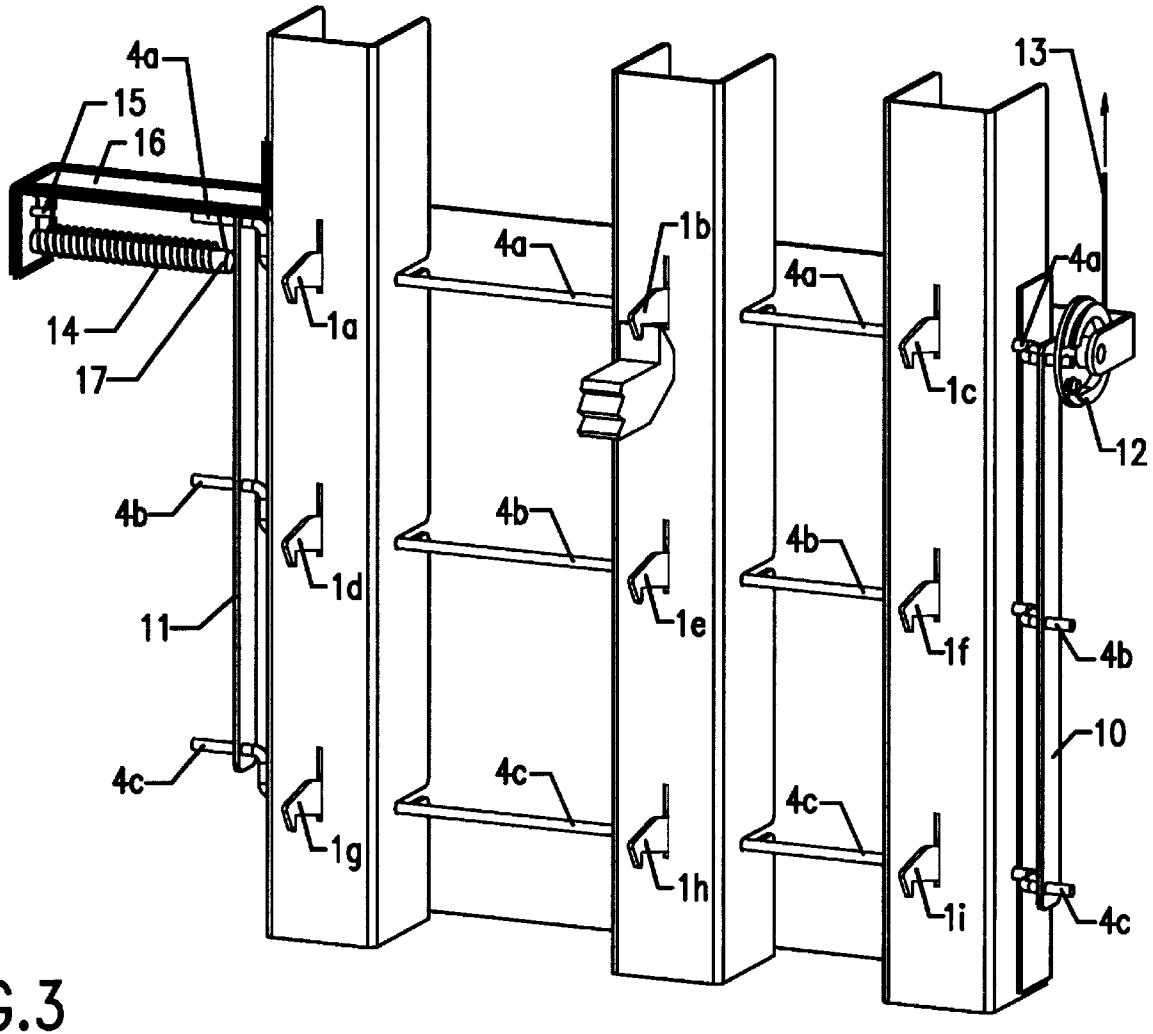
FIG. 3 provides a perspective view of a preferred implementation of the latch mechanism of the present invention, in a cabinet having three rows and three columns of drawers.

FIG. 3 shows the preferred embodiment of a latch mechanism for use in a cabinet having nine drawers, arranged in three rows and three columns. Crankshafts 4*a*–4*c* are connected by drive link 10 such that the crankshafts rotate synchronously. A second similar drive link 11, on the opposite end of the crankshafts, and rotationally out of phase with drive link 10, provides additional rotational coupling among crankshafts 4*a*–4*c*. The synchronous rotation of crankshafts 4*a*–4*c* causes the latch fingers 1*a*–1*i* to move in unison.

Figure 4:
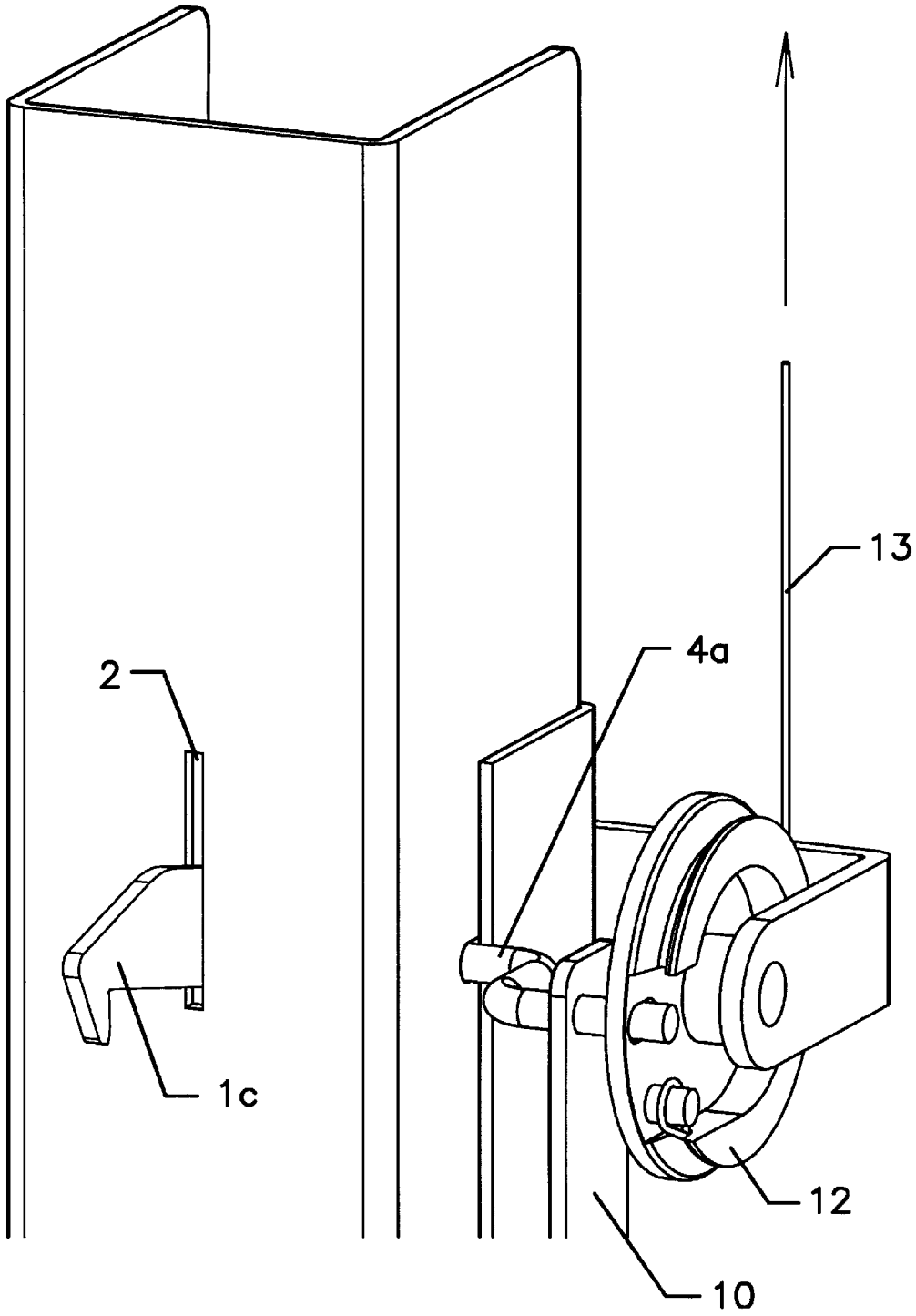
FIG. 4 provides a partial perspective view of the latch mechanism of the present invention, and showing the means for driving the crankshaft.

FIG. 4 provides a partial view of the latch mechanism showing drum 12 and cable 13 connected to crankshaft 4*a*. Drum 12 is rotationally connected to crankshaft 4*a* and has cable 13 affixed to it such that pulling on the cable in the direction of the arrow will rotate the drum counterclockwise, and the drum will cause synchronous rotation of crankshafts 4*a*–4*c*.

During the latching cycle, torsion spring 14, shown in FIG. 3, opposes the motion of crankshaft 4*a*, storing energy which is used later to unlatch the drawers. One end of the torsion spring is acted on by the end of crankshaft 4*a* such that the spring is wound as cable 13 is pulled in the direction of the arrow. The other end of the torsion spring is prevented from rotating by pin 15 which is attached to stationary bracket 16. Shaft 17 is attached to bracket 16 and provides support for spring 14. The energy stored in spring 14 during the latching motion is used to return the latch mechanism to its unlatched position when tension in the cable 13 is released. Cable 13 is connected by a plurality of pulleys (not shown) to the lock mechanism shown schematically in FIGS. 5A–5I.

FIGS. 5A–5I provide schematic views of the lock mechanism of the present invention. The lock mechanism provides the motive force for the latch mechanism, and provides means for locking the latch mechanism in the latched position shown in FIG. 2D. The lock mechanism also provides means for unlocking the drawer, by allowing the latch mechanism to return to the unlatched condition shown in FIG. 2A.

In FIGS. 5A–5I, slider 19 and handle 20 move up and down on guide rod 18. Cable 13, a portion of which is shown in the figures, is attached to slider 19 by means of pin 21. Cable 13 connects to pulley 12 in FIG. 4 through a plurality of pulleys, one of which, namely pulley 22, is shown in each of FIGS. 5A–5I.

Figure 5A:
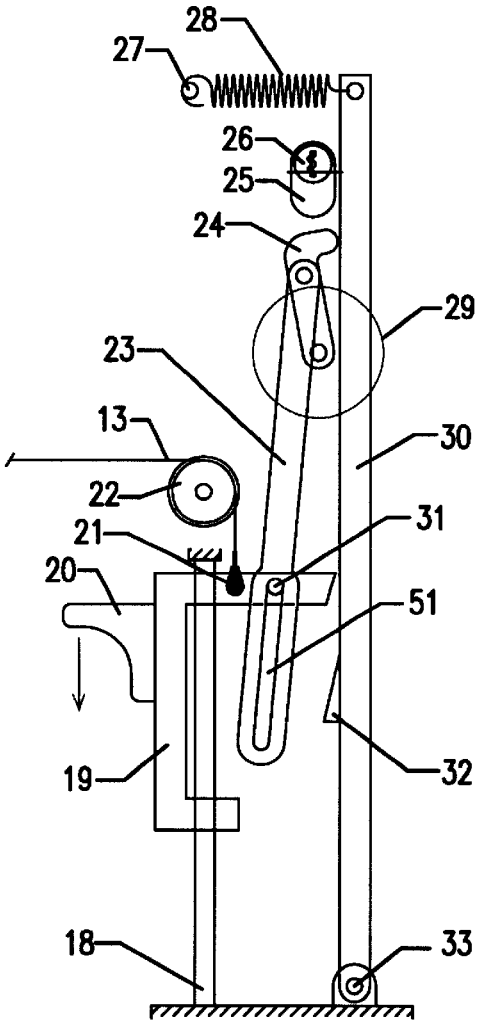
FIGS. 5A–5I provide schematic views showing the lock mechanism of the present invention, at various points in its operating cycle.
Figure 5B:
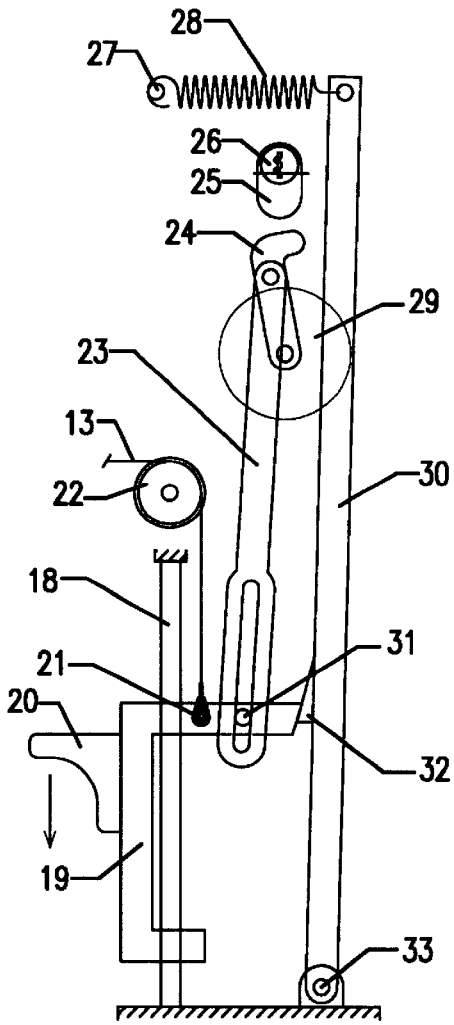
Figure 5C:
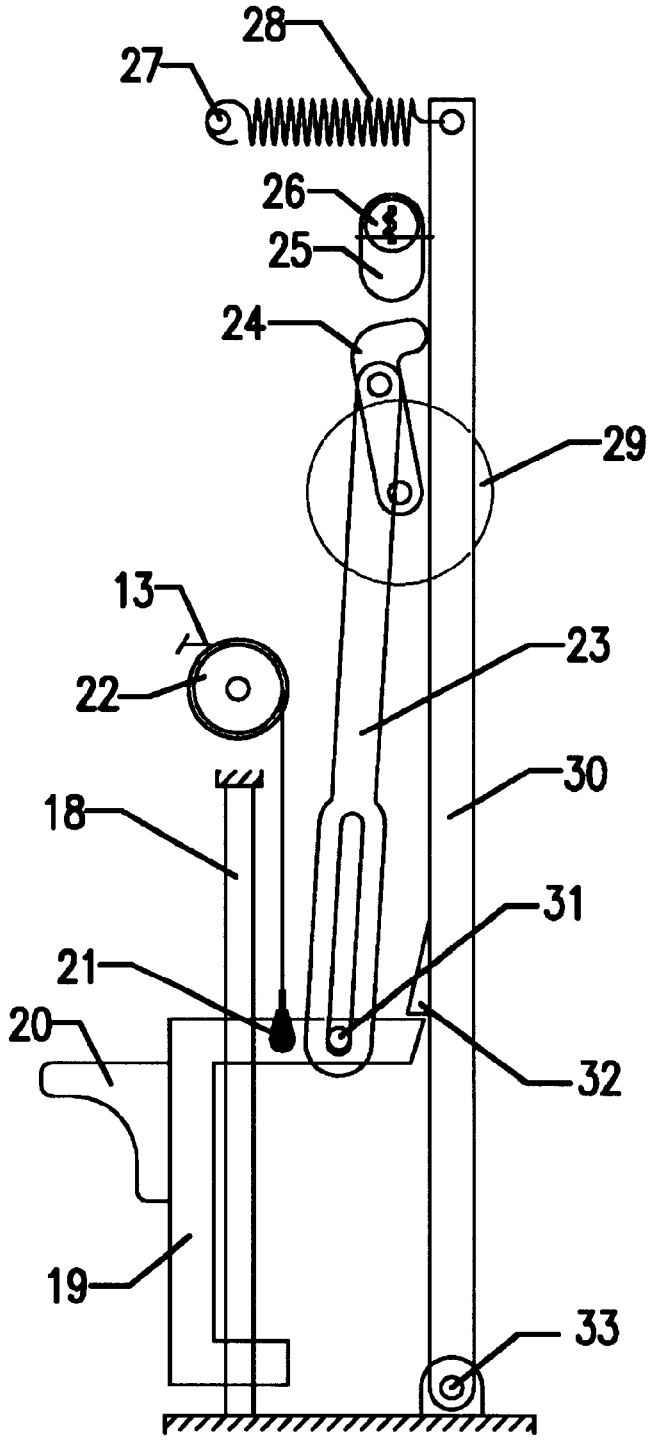

FIG. 5A shows the lock mechanism in its unlocked or home position. Downward motion of slider 19 results in counterclockwise motion of pulley 12, actuating the latch mechanism, i.e. placing the latch mechanism in the position shown in FIG. 2D. Slider 19 may be moved downward manually by pushing on handle 20 until the tip of the slider passes ramp 32 on lock arm 30, and is restrained below the ramp 32. The slot 51 in link 23 allows this motion to occur without requiring motion of drive arm 24. Lock arm 30 is displaced as the tip of slider 19 passes ramp 32, as shown in FIG. 5B, rotating lock arm 30 about pivot point 33. One end of spring 28 is connected to the end of lock arm 30, and the other end of spring 28 is restrained by stationary pin 27. Once the tip of slider 19 has passed by ramp 32, spring 28 returns lock arm 30 to its undisplaced position, preventing upward motion of slider 19, and holding the latch mechanism, via cable 13, in the locked position shown in FIG. 2D. This condition of the lock mechanism is shown in FIG. 5C.

Figure 5D:
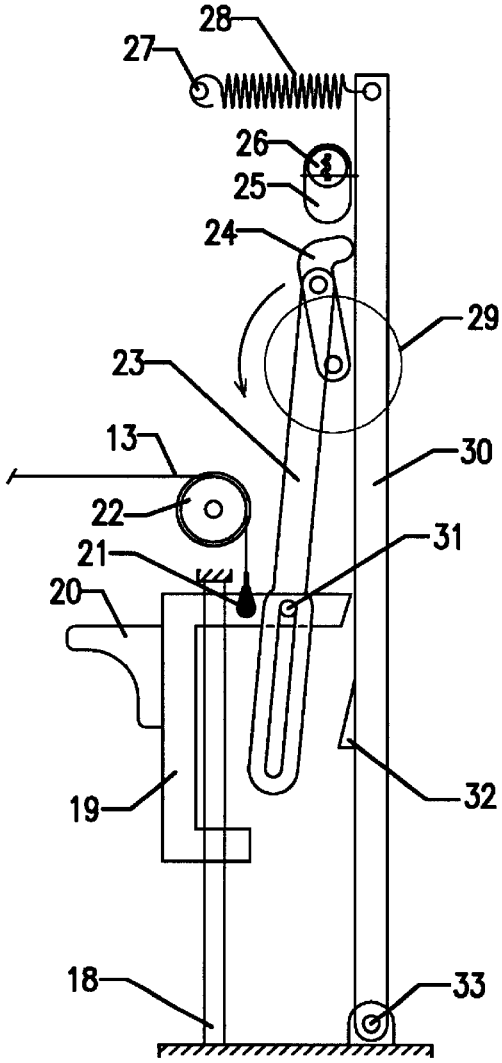
Figure 5E:
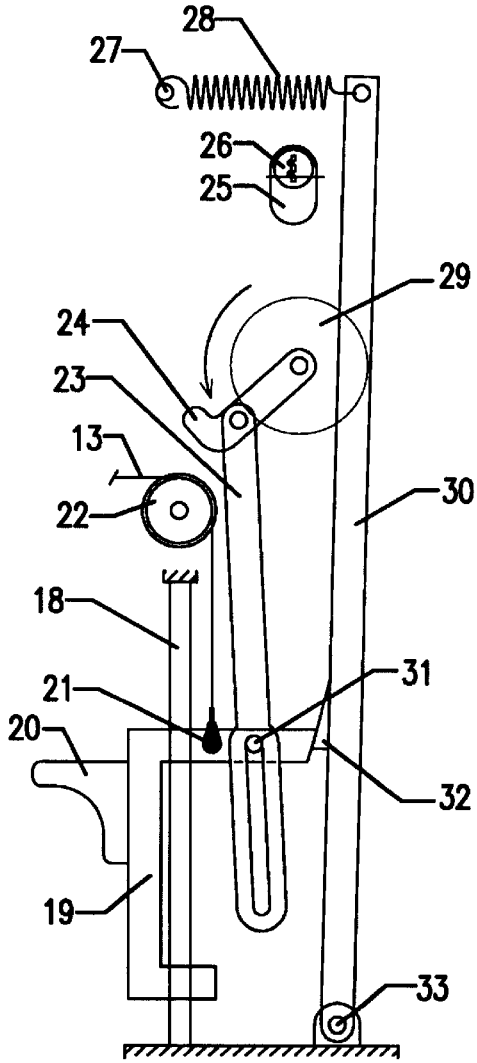
Figure 5F:
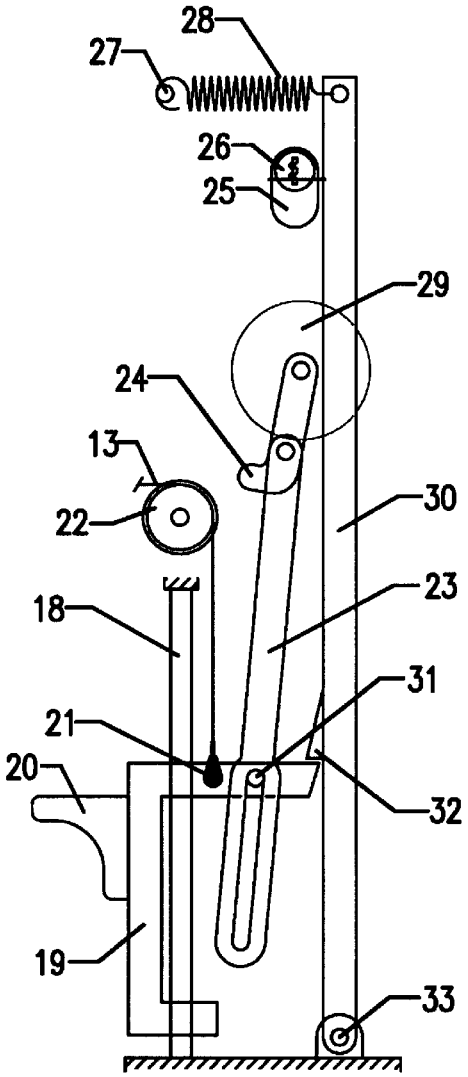
Figure 5G:
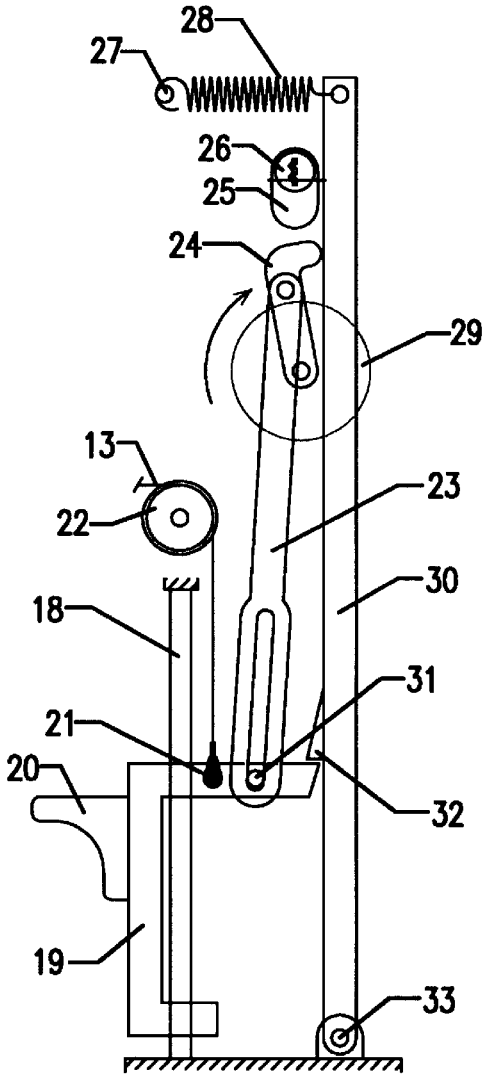

The slider may alternatively be pushed down by the action of motor 29 acting through drive arm 24 and link 23, as shown in FIG. 5D. As motor 29 rotates drive arm 24 counterclockwise, link 23 is forced downward against pin 31 which is attached to slider 19. FIG. 5E shows the lock mechanism part way through the locking motion, with the tip of slider 19 contacting ramp 32 and displacing lock arm 30 against the restraining force of spring 28. When the motion has proceeded sufficiently such that the tip of the slider 19 is below ramp 32, as shown in FIG. 5F, and spring 28 has returned lock arm 30 and the attached ramp 32 to their original locations, thereby preventing upward motion of slider 19, motor 29 returns drive arm 24 to its initial position as shown in FIG. 5G.

Figure 5H:
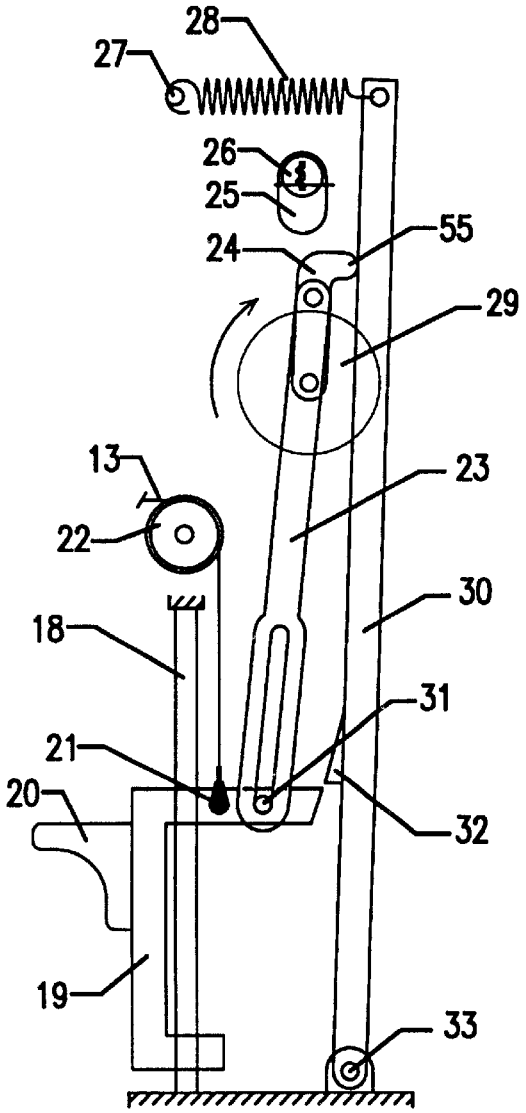

As shown in FIG. 5H, motor 29 may also be used to unlock the mechanism by rotating drive arm 24 clockwise. The drive arm includes an outer end 55 which, when the drive arm is rotated clockwise, contacts lock arm 30. The outer end 55 of the drive arm displaces the lock arm sufficiently to move ramp 32 out of engagement with the tip of slider 19. The tension in cable 13, provided by torsion spring 14, raises slider 19 to its original position, as shown in FIG. 5A, and allows the latch mechanism to return to its unlatched position as shown in FIG. 2A. Motor 29 then returns the drive arm 24 to its initial position, leaving the lock mechanism in the condition shown in FIG. 5A.

Figure 5I:
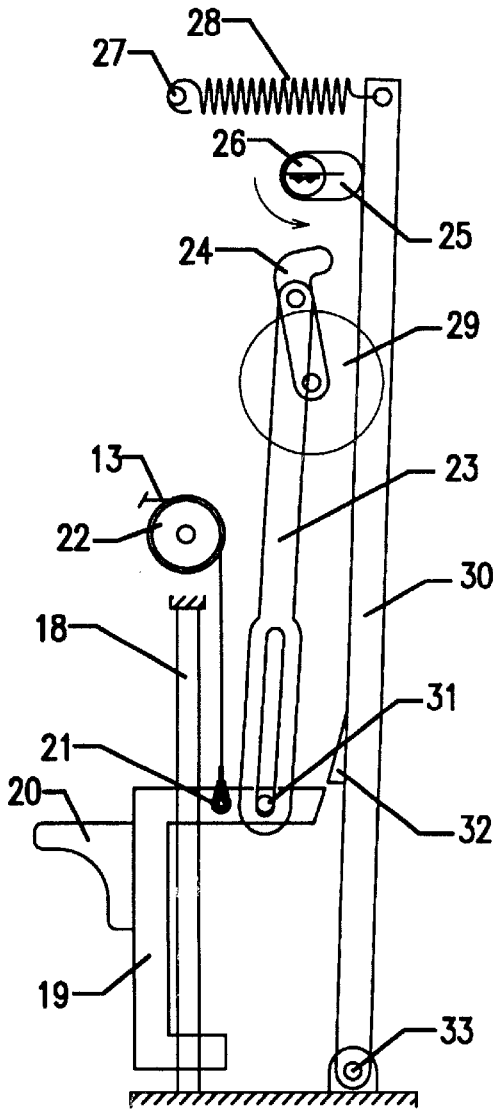

Alternatively, the mechanism may be unlocked by inserting a key in lock 26 and rotating it counterclockwise until attached cam 25 contacts the lock arm and displaces the lock arm sufficiently to allow ramp 32 to disengage the tip of slider 19. This condition is shown in FIG. 5I.

When the lock mechanism unlocks the drawers, any of the drawers may then be opened manually. The lock mechanism does not cause the drawers to slide to an open position, but simply releases the latch fingers so that the drawers can be opened by an operator.

The latch mechanism of the present invention can be used with a single drawer or with a plurality of drawers, such as would be found in a cabinet of drawers.

In the embodiment wherein the system is operated by a motor, a controller can be provided to actuate the motor, so as to close and lock the drawers after some predetermined period has elapsed since the drawers were last opened.

The cabinet of the present invention may also be unlocked through the use of a security code, which could be used to actuate the motor which unlocks the drawers.

In the preferred embodiment, the lock and latch mechanisms are disposed within the same cabinet.

In the embodiments described above, there is one latch finger for each drawer. The invention need not be so limited, however. If a drawer is relatively wide, it may be desirable to provide two or more latch fingers for such a drawer. Within a given cabinet, some drawers (particularly the narrow drawers) may be associated with only one latch fingers, while other drawers (usually the wide drawers) are associated with two or more latch fingers. The invention is intended to cover all such possible variations.

The invention can be modified in other ways, as will be apparent to those skilled in the art. The number and arrangement of drawers can be varied. The number of pulleys between the latch mechanism and the lock mechanism can be changed, as can the distance between the lock and latch mechanisms, as long as the cable is held in tension or relaxed at the required times. These and other similar modifications should be considered within the spirit and scope of the following claims.

What is claimed is:

1. A latching mechanism for a drawer, comprising:

a) a catch connected to a drawer, b) a latch finger shaped to engage the catch, the latch finger having a slot, c) front and rear plates, the front and rear plates having openings through which the latch finger extends, and d) a crankshaft, disposed between the front and rear plates, the crankshaft being sized to fit within the slot.

2. The latching mechanism of claim 1, wherein the crankshaft includes a driven portion and an eccentric portion, and wherein the eccentric portion engages the slot.

3. The latching mechanism of claim 1, wherein both the latch finger and the catch have ramped surfaces which allow the latch finger to ride over the catch.

4. The latching mechanism of claim 1, wherein the openings have upper and lower ends which define limits for upward and downward movement of the latch finger.

5. The latching mechanism of claim 1, further comprising a torsion spring connected to the crankshaft, wherein turning of the crankshaft in a direction necessary to latch the latching mechanism is opposed by the torsion spring.

6. The latching mechanism of claim 1, wherein the crankshaft is connected to a drum which is rotated by a cable affixed to the drum.

7. The latching mechanism of claim 6, wherein the cable is connected to a lock mechanism, the lock mechanism comprising:

a) a slider connected to the cable, the slider having a tip, and b) a lock arm mounted for movement about a pivot point, the lock arm having a ramp, wherein movement of the slider towards the pivot point causes the tip to become engaged with the ramp so as to hold the cable in tension.

8. The latching mechanism of claim 7, wherein the lock arm is spring-biased to move towards the slider.

9. The latching mechanism of claim 7, further comprising a motor connected to the slider by a drive arm and a link.

10. The latching mechanism of claim 9, wherein the drive arm includes an outer end which moves the lock arm so as to unlock the lock mechanism.

11. The latching mechanism of claim 9, wherein the locking mechanism includes a lock having an attached cam, the cam being positioned to contact the lock arm when the lock is rotated, so as to unlock the lock mechanism.

12. A locking and latching mechanism for a plurality of drawers, the drawers being arranged in rows and columns, each drawer having a latching mechanism according to claim 1, wherein there is a crankshaft for each row for latching and unlatching all drawers in a row simultaneously.

13. The mechanism of claim 12, wherein the crankshafts are connected by a drive link.

14. A latching mechanism for a drawer, comprising:

a) a catch connected to a drawer, b) a latch finger having means for engaging the catch, and c) means for moving the latch finger so as to engage the catch before the drawer has been fully closed, and for pulling the latch finger so as to close the drawer, wherein the latch finger moving means comprises means for moving the latch finger in an upward and downward, and a forward and backward motion.

15. The latching mechanism of claim 14, further comprising means for opposing a pulling force applied to the latch finger to close the drawer, wherein said opposing means causes unlatching of the drawer when the pulling force is removed.

16. A latching mechanism for a drawer, comprising:

a) a catch connected to a drawer, b) a latch finger having means for engaging the catch, and c) means for moving the latch finger so as to engage the catch before the drawer has been fully closed, and for pulling the latch finger so as to close the drawer, wherein the engaging and pulling means includes a cable under tension, the cable being connected to urge the latch finger to pull the drawer towards a closed position.

17. The latching mechanism of claim 16, wherein the cable is held in tension by a lock mechanism, the lock mechanism comprising a slider and a lock arm, and means for engaging the slider with the lock arm so as to prevent relaxation of tension in the cable.

18. The latching mechanism of claim 17, wherein the lock arm is pivotable, wherein pivoting of the lock arm causes disengagement of the slider with the lock arm, wherein lock mechanism becomes unlocked.

19. The latching mechanism of claim 17, wherein the slider includes a handle so as to be manually operated.

20. The latching mechanism of claim 17, wherein the slider is operated by a motor connected to the slider by a link, wherein the motor also comprises means for disengaging the lock arm from the slider.

21. The latching mechanism of claim 17, further comprising a lock having a cam, the cam being positioned to disengage the lock arm from the slider when the lock is turned.

22. A locking mechanism for a drawer, comprising:

a) a latch mechanism, the latch mechanism being connected to a cable, the latch mechanism being in a latched condition when the cable is under tension and being in an unlatched condition when the cable is not under tension, and b) means for applying and maintaining tension in the cable, so as to latch the latch mechanism, and for relaxing tension in the cable, so as to unlatch the latch mechanism, wherein the tension applying and maintaining means includes a slider connected to the cable, and means for holding the slider in a position which applies tension to the cable.

23. The locking mechanism of claim 22, wherein the tension applying and maintaining means includes a pivotable lock arm, the lock arm having means for engaging the slider, the lock arm being spring-biased to remain in engagement with the slider, wherein the lock arm can be pivoted out of engagement with the slider to relax tension in the cable.

24. The locking mechanism of claim 23, further comprising a motor connected to move the slider so as to apply and relax tension in the cable, and means connected to the motor for pivoting the lock arm out of engagement with the slider.

25. The locking mechanism of claim 24, further comprising a lock having a cam positioned to contact the lock arm when the lock is turned, the cam comprising means for pivoting the lock arm out of engagement with the slider.

26. A latching mechanism for a drawer, comprising:

a) a catch connected to a drawer, b) a latch finger shaped to engage the catch, c) a crankshaft connected to the latch finger so as to move the latch finger in an upward and downward, and forward and backward motion, wherein backward motion of the latch finger, when the latch finger is engaged with the catch, causes the drawer to become closed and latched.

27. The latching mechanism of claim 26, wherein the latch finger includes a slot, wherein the crankshaft includes a driven portion and an eccentric portion, and wherein the eccentric portion engages the slot.

28. The latching mechanism of claim 26, wherein both the latch finger and the catch have ramped surfaces which allow the latch finger to ride over the catch.

29. The latching mechanism of claim 26, further comprising means for limiting upward and downward movement of the latch finger.

30. The latching mechanism of claim 26, further comprising a torsion spring connected to the crankshaft, wherein turning of the crankshaft in a direction necessary to latch the latching mechanism is opposed by the torsion spring.

31. The latching mechanism of claim 26, wherein the crankshaft is connected to a drum which is rotated by a cable affixed to the drum.

32. The latching mechanism of claim 31, wherein the cable is connected to a lock mechanism, the lock mechanism comprising:

a) a slider connected to the cable, the slider having a tip, and b) a lock arm mounted for movement about a pivot point, the lock arm having a ramp, wherein movement of the slider towards the pivot point causes the tip to become engaged with the ramp so a s to hold the cable in tension.

33. The latching mechanism of claim 32, wherein the lock arm is spring-biased to move towards the slider.

34. The latching mechanism of claim 32, further comprising a motor connected to the slider by a drive arm and a link.

35. The latching mechanism of claim 34, wherein the drive arm includes an outer end which moves the lock arm so as to unlock the lock mechanism.

36. The latching mechanism of claim 34, wherein the locking mechanism includes a lock having an attached cam, the cam being positioned to contact the lock arm when the lock is rotated, so as to unlock the lock mechanism.

37. A locking and latching mechanism for a plurality of drawers, the drawers being arranged in rows and columns, each drawer having a latching mechanism according to claim 26, wherein there is a crankshaft for each row for latching and unlatching all drawers in a row simultaneously.

38. A method of latching and unlatching a cabinet of drawers, comprising:

a) moving a slider so as to create tension in a cable, the cable being connected to turn a crankshaft, the crankshaft being operatively connected to a finger having means for engaging a catch connected to a drawer, wherein the drawer is pulled by the finger to a closed and latched position, b) observing the drawers to determine whether any drawers are not fully closed, c) manually closing any drawers determined to be not fully closed, wherein all of the drawers in the cabinet become closed and latched, and d) relaxing tension in the cable when it is desired to open the drawers.

39. The method of claim 38, wherein the moving step comprises operating a motor to move the slider.

40. The method of claim 38, wherein step (c) comprises sliding a drawer past a finger such that the catch connected to the drawer slides past the finger and becomes engaged therewith.

41. The method of claim 38, wherein step (a) comprises moving the slider until it engages a ramp which holds the slider in a given position so as to maintain a locked condition of the cabinet.

42. The method of claim 41, wherein step (d) comprises releasing the slider from the ramp such that the slider is free to move to a position that reduces tension in the cable.

43. A method of latching and unlatching a cabinet of drawers, comprising:

a) pulling all drawers shut which are within a predetermined distance from a fully closed position, and latching said drawers, b) observing all of the drawers of the cabinet to determine whether any drawers are not fully closed, and c) manually closing any drawers determined to be not fully closed, wherein all of the drawers in the cabinet become closed and latched, wherein each drawer is associated with a latch finger, and wherein step (a) is performed by moving each latch finger in an upward and downward, and a forward and backward motion, so as to cause each latch finger to engage the drawer and pull the drawer closed.

44. Apparatus for latching and locking a plurality of drawers in a cabinet, comprising:

a) means for pulling all drawers shut which drawers are initially within a predetermined distance from a fully closed position, and for latching said drawers, b) means for holding said drawers in a latched condition, and c) means for unlatching said drawers, wherein the drawer pulling and latching means comprises a latch finger associated with each drawer, and means for moving each latch finger in an upward and downward, and a forward and backward motion, so as to cause each latch finger to engage the drawer and pull the drawer closed.

* * * * *